US008866576B2

(12) United States Patent
Park et al.

(10) Patent No.: US 8,866,576 B2
(45) Date of Patent: Oct. 21, 2014

(54) TRANSFORMER AND DISPLAY DEVICE USING THE SAME

(75) Inventors: Geun Young Park, Gyunggi-do (KR); Young Min Lee, Gyunggi-do (KR); Jae Sun Won, Gyunggi-do (KR); Jong Hae Kim, Gyunggi-do (KR); Deuk Hoon Kim, Gyunggi-do (KR)

(73) Assignee: Samsung Electro-Mechanics Co., Ltd., Suwon-si, Gyunggi-do (KR)

( * ) Notice: Subject to any disclaimer, the term of this patent is extended or adjusted under 35 U.S.C. 154(b) by 0 days.

(21) Appl. No.: 13/477,880

(22) Filed: May 22, 2012

(65) Prior Publication Data

US 2013/0002386 A1 Jan. 3, 2013

(30) Foreign Application Priority Data

Jun. 30, 2011 (KR) ..... 10-2011-0065120

(51) Int. Cl.
*H01F 27/28* (2006.01)

(52) U.S. Cl.
USPC ..... 336/192

(58) Field of Classification Search
USPC ..... 336/192, 196, 198, 200
See application file for complete search history.

(56) References Cited

FOREIGN PATENT DOCUMENTS

| | | | |
|---|---|---|---|
| JP | 5-066938 | | 9/1993 |
| JP | 06112058 A | * | 4/1994 |
| JP | 2004-172233 | | 6/2004 |
| JP | 2007-035664 A | | 2/2007 |
| KR | 10-2007-0014723 A | | 2/2007 |

OTHER PUBLICATIONS

Korean Office Action, and English translation thereof, issued in Korean Patent Application No. 10-2011-0065120 dated May 16, 2012.

* cited by examiner

*Primary Examiner* — Tuyen Nguyen
(74) *Attorney, Agent, or Firm* — McDermott Will & Emery LLP

(57) ABSTRACT

There is provided a transformer capable of significantly reducing leakage inductance while satisfying safety standards. The transformer includes: a winding part having a plurality of coils wound on an outer peripheral surface of a pipe shaped body part while being stacked thereon; and a terminal connection part extended from one end of the winding part in an outer diameter direction thereof and having a plurality of external connection terminals coupled to a distal end thereof, the terminal connection part including at least one catching groove formed such that the coils are led to the outside of the winding part therethrough, and a lead wire of at least one of the coils being led to the outside of the winding part while maintaining a winding direction of the coils.

17 Claims, 7 Drawing Sheets

B'–B'''

C–C'

TRANSFORMER AND DISPLAY DEVICE USING THE SAME

CROSS-REFERENCE TO RELATED APPLICATIONS

This application claims the priority of Korean Patent Application No. 10-2011-0065120 filed on Jun. 30, 2011, in the Korean Intellectual Property Office, the disclosure of which is incorporated herein by reference.

BACKGROUND OF THE INVENTION

1. Field of the Invention

The present invention relates to a transformer, and more particularly, to a transformer capable of significantly reducing leakage inductance while satisfying safety standards.

2. Description of the Related Art

Various kinds of power supplies are required in various electronic devices such as a television (TV), a monitor, a personal computer (PC), an office automation (OA) device, and the like. Therefore, these electronic devices generally include power supplies converting alternating current (AC) power supplied from the outside into power having an appropriate level for individual electronic appliances.

Among power supplies, a power supply using a switching mode (for example, a switched-mode power supply (SMPS)) has mainly been used. An SMPS basically includes a switching transformer.

The switching transformer generally converts AC power of 85 to 265 V into direct current (DC) power of 3 to 30 V through high frequency oscillation at 25 to 100 KHz. Therefore, in the switching transformer, a core and a bobbin may be significantly reduced in size as compared to a general transformer converting AC power of 85 to 265 V into DC current of 3 to 30 V through frequency oscillation at 50 to 60 Hz, and low voltage and low current DC power may be stably supplied to an electronic appliance. Therefore, the switching transformer has been widely used in electronic appliances that have tended to be miniaturized.

This switching transformer should be designed to have relatively low leakage inductance in order to increase energy conversion efficiency. However, in accordance with the miniaturization of the switching transformer, it is not easy to design a switching transformer having small leakage inductance.

In addition, in the case in which a small-sized transformer, as described above, is manufactured, since a primary coil and a secondary coil are disposed to be immediately adjacent to each other, it may be difficult to satisfy safety standards (that is, those of Underwriters Laboratories (UL)) due to the arrangement thereof.

SUMMARY OF THE INVENTION

An aspect of the present invention provides a small-sized switching transformer.

Another aspect of the present invention provides a transformer capable of significantly reducing leakage inductance.

Another aspect of the present invention provides a transformer satisfying safety standards with regard to a primary coil and a secondary coil.

According to an aspect of the present invention, there is provided a transformer including: a winding part having a plurality of coils wound on an outer peripheral surface of a pipe shaped body part while being stacked thereon; and a terminal connection part extended from one end of the winding part in an outer diameter direction thereof and having a plurality of external connection terminals coupled to a distal end thereof, the terminal connection part including at least one catching groove formed such that the coils are led to the outside of the winding part therethrough, and a lead wire of at least one of the coils being led to the outside of the winding part while maintaining a winding direction of the coils.

A length of the catching groove may be larger than a thickness of the terminal connection part in which the catching groove is formed.

When the length of the catching groove is regarded as W and the thickness of the terminal connection part in which the catching groove is formed is regarded as T, $W/T>1$.

The lead wire led through the catching groove may form an angle of less than 45 degrees with respect to the coils wound in the winding part while being led.

At least two of the lead wires led through the catching groove may be disposed to intersect each other in an X shape in the catching groove.

The terminal connection part may further include at least one lead groove formed in a radial direction, and the catching groove may be formed in the lead groove in a manner in which a width of the lead groove is extended.

The winding part may include a plurality of winding spaces formed by at least one partition wall on the outer peripheral surface of the body part, and the coils may be wound such that they are disposed in the plurality of spaces divided by the partition wall in a dispersed scheme.

The partition wall may include at least one skip groove, and the coils may be wound while skipping the partition wall via the skip groove.

The coils may include a plurality of primary coils and a plurality of secondary coils, and the catching groove may be formed in a position corresponding to the primary coil or the secondary coil that is continuously wound in the winding part while being stacked therein.

The coils may be continuously wound so that the plurality of secondary coils are interposed between the plurality of primary coils while being stacked therebetween.

At least one of the primary coil and the secondary coil may be a multi-insulated coil.

The terminal connection part may include at least one catching protrusion protruded from an outer surface thereof, and the lead wire led through the catching groove may be disposed in an altered direction while supporting the catching protrusion.

The catching protrusion may be formed in a position adjacent to the catching groove.

At least one of the catching grooves may be a double catching protrusion having a step formed at a side thereof.

The double catching protrusion may include: a base protrusion protruded so that a distal end thereof has a predetermined area and simultaneously supports at least two of the lead wires using the distal end thereof and a sidewall thereof; and a support protrusion further protruded from any one portion in the distal end of the base protrusion.

The catching groove may be formed as an elongated cut in a winding direction of the coils or formed to have an arc, and the leads wires of the coils may be led to the outside while crossing the catching groove in a length direction of the catching groove.

According to another aspect of the present invention, there is provided a transformer including: a winding part having a plurality of coils wound on an outer peripheral surface of a pipe shaped body part while being stacked thereon; and a terminal connection part extended from one end of the winding part in an outer diameter direction thereof and having a plurality of external connection terminals coupled to a distal end thereof, a lead wire of at least one of the coils being led to the outside of the terminal connection part while forming an angle less than 45 degrees with respect to the coils wound in the winding part.

According to another aspect of the present invention, there is provided a display device including: a switching mode power supply including at least one transformer as described above mounted on a substrate; a display panel receiving power supplied from the switching mode power supply; and covers protecting the display panel and the switching mode power supply.

A coil of the transformer may be wound so as to be parallel to the substrate of the switching mode power supply.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EMBODIMENTS

Figure 1:
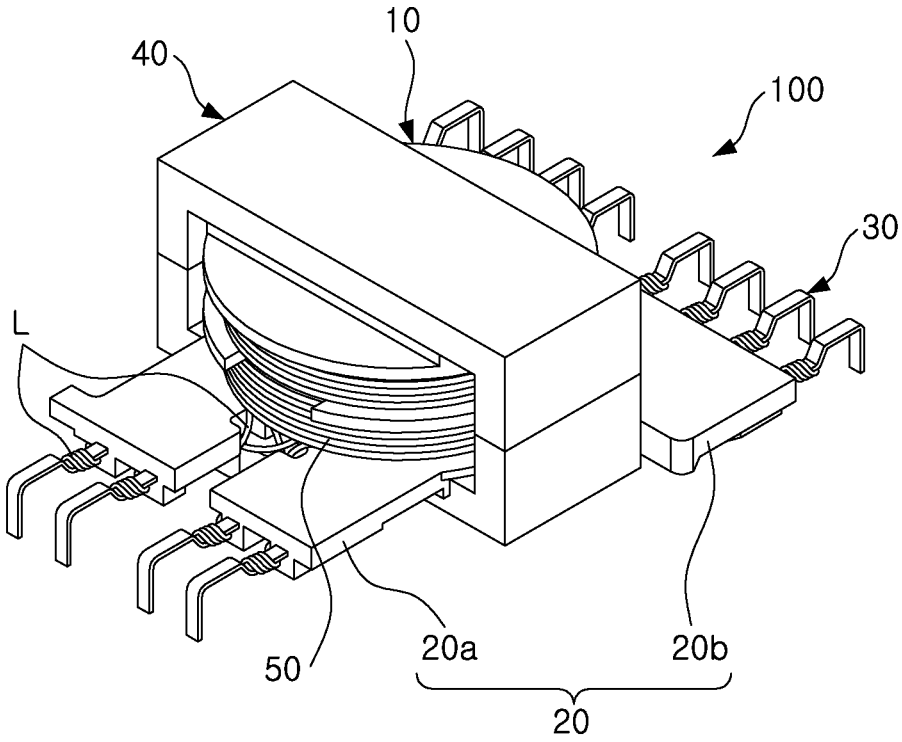
FIG. 1 is a perspective view schematically showing a transformer according to an embodiment of the present invention.

The terms and words used in the present specification and claims should not be interpreted as being limited to typical meanings or dictionary definitions, but should be interpreted as having meanings and concepts relevant to the technical scope of the present invention based on the rule according to which an inventor can appropriately define the concept of the term to appropriately describe the method he or she knows for carrying out the invention. Therefore, the configurations described in the embodiments and drawings of the present invention are merely the embodiments, but do not represent all of the technical spirit of the present invention. Thus, the present invention should be construed as including all the changes, equivalents, and substitutions included in the spirit and scope of the present invention at the time of the filing of this application.

Hereinafter, embodiments of the present invention will be described in detail with reference to the accompanying drawings. At this time, it is noted that like reference numerals denote like elements in appreciating the drawings. Moreover, detailed descriptions related to well-known functions or configurations will be ruled out in order not to unnecessarily obscure the subject matter of the present invention. Based on the same reason, it is to be noted that some components shown in the drawings are exaggerated, omitted or schematically illustrated, and the size of each component does not accurately reflect its real size.

Meanwhile, safety standards disclosed in the present embodiment refer to standards defined by Underwriters Laboratories Inc. with respect to a structure, an embedded component, a wiring method, and the like, of an electronic device. However, the present invention is not limited thereto.

Hereinafter, embodiments of the present invention will be described in detail with reference to the accompanying drawings.

Figure 2A:
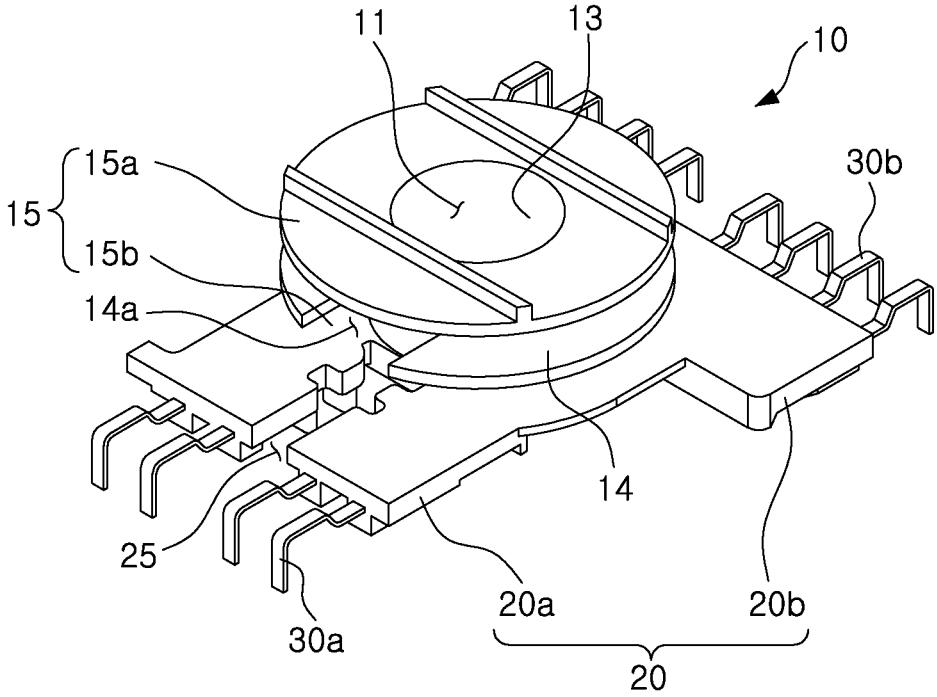
FIG. 2A is a perspective view schematically showing a bobbin of the transformer shown in FIG. 1.
Figure 2B:
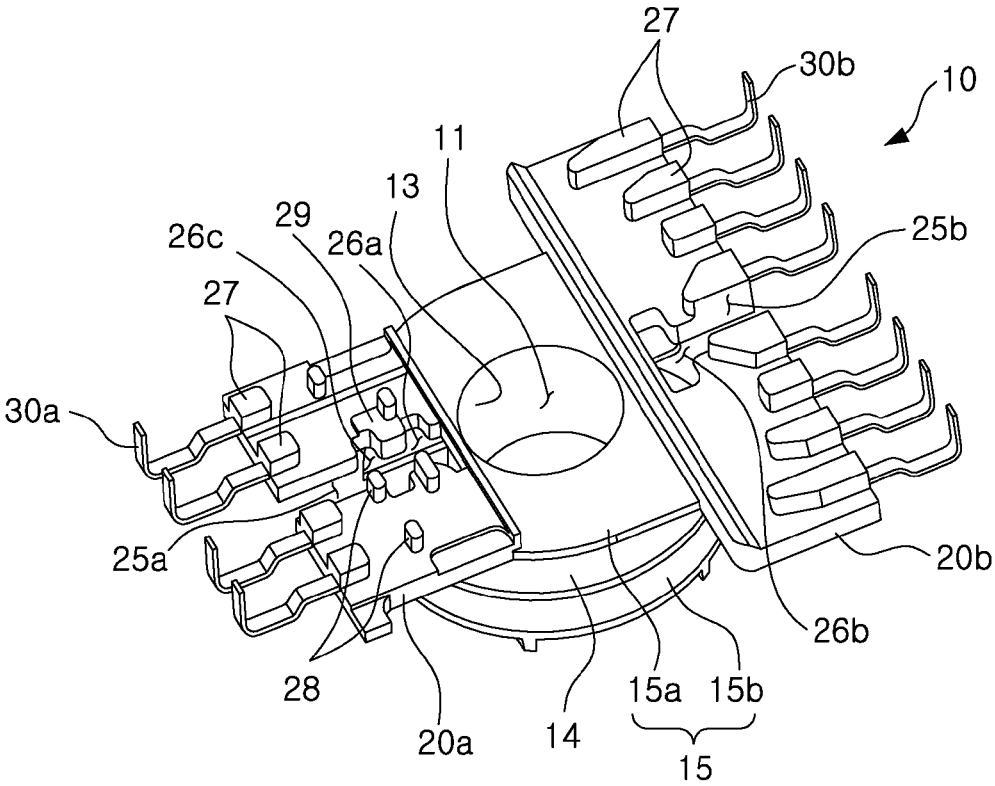
FIG. 2B is a perspective view schematically showing a lower surface of the bobbin shown in FIG. 2A.

FIG. 1 is a perspective view schematically showing a transformer according to an embodiment of the present invention; FIG. 2A is a perspective view schematically showing a bobbin of the transformer shown in FIG. 1; and FIG. 2B is a perspective view schematically showing a lower surface of the bobbin shown in FIG. 2A.

Figure 3A:
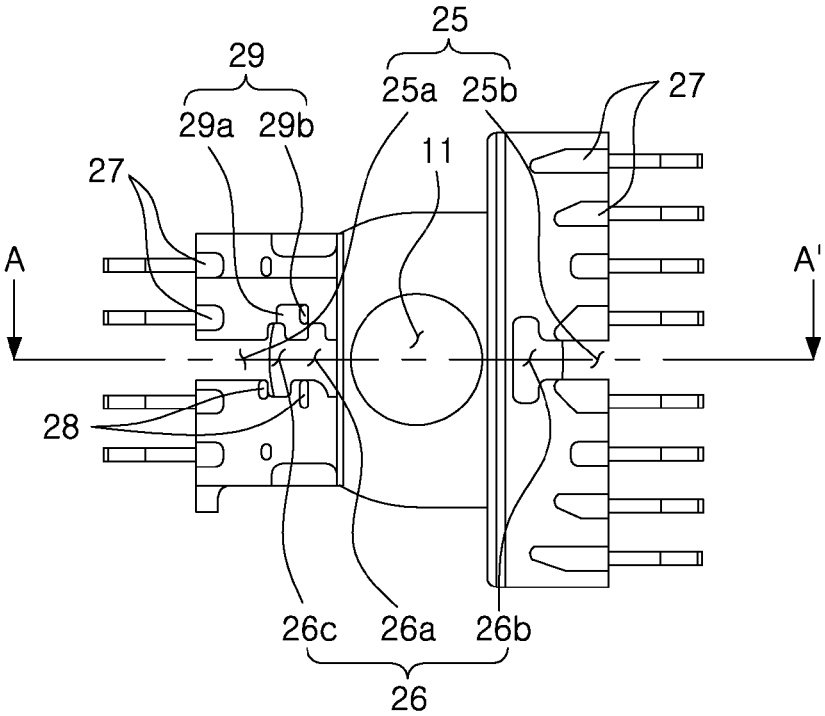
FIG. 3A is a bottom view showing the lower surface of the bobbin shown in FIG. 2A.
Figure 3B:
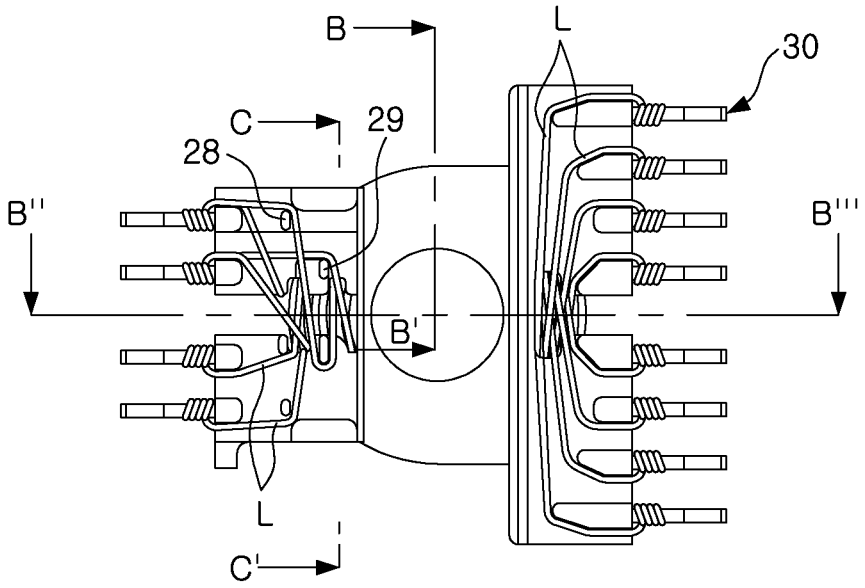
FIG. 3B is a bottom view showing a state in which a coil is wound in the bobbin shown in FIG. 3A.
Figure 4:
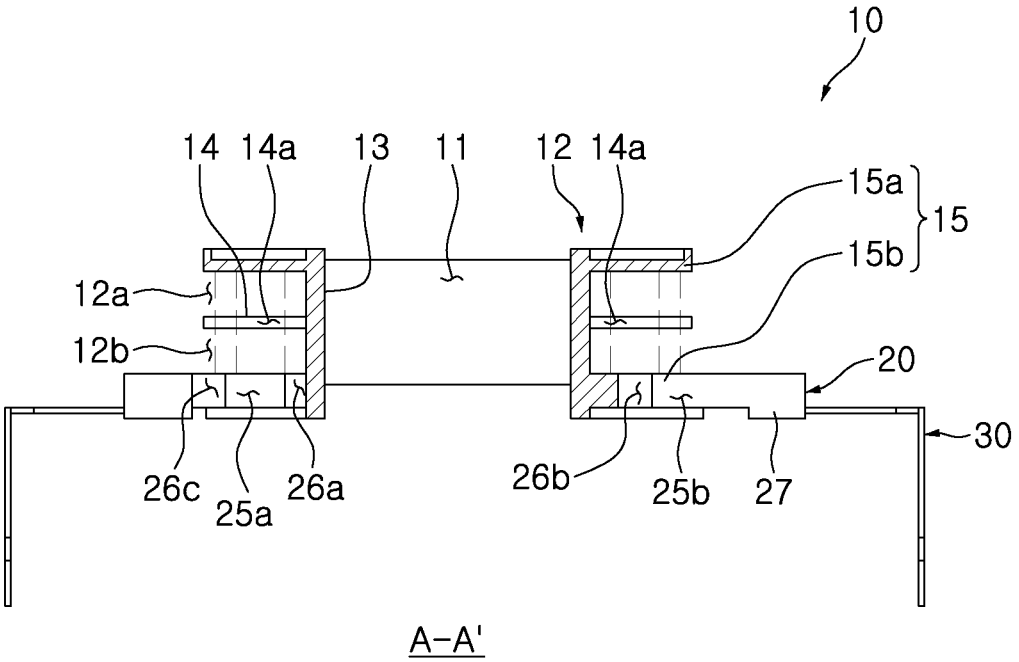
FIG. 4 is a cross-sectional view taken along line A-A' of FIG. 3A.

FIG. 3A is a bottom view showing the lower surface of the bobbin shown in FIG. 2A; and FIG. 3B is a bottom view showing a state in which a coil is wound in the bobbin shown in FIG. 3A. FIG. 4 is a cross-sectional view taken along line A-A' of FIG. 3A.

Referring to FIGS. 1 through 4, the transformer 100 according to the embodiment of the present invention, an insulating type switching transformer, may include a bobbin 10, a core 40, and a coil 50.

The bobbin 10 may include a winding part 12 having the coil 50 wound therein and a terminal connection part 20 formed at one end of the winding part 12.

The winding part 12 may include a body part 13 having a pipe shape and a flange part 15 extended from both ends of the body part 13 in an outer diameter direction.

The body part 13 may include a through hole 11 formed in an inner portion thereof and at least one partition wall 14 formed on an outer peripheral surface thereof, wherein the through hole 11 includes the core 40 partially inserted thereinto and the partition wall 14 partitions a space in a length direction of the body part 13. In this configuration, the coil 50 may be wound in each of the spaces partitioned by the partition wall 14.

The winding part 12 according to the present embodiment may include one partition wall 14. Therefore, the winding part 12 according to the present embodiment may include two winding spaces 12*a* and 12*b* as partitioned spaces. However, the present invention is not limited thereto, and a number of partitions may be formed and used through a number of partition walls 14 as needed.

In addition, the partition wall 14 according to the present embodiment may include at least one skip groove 14*a* formed therein so that the coil 50 wound in a specific space, for example, an upper space 12*a* among the two winding spaces 12*a* and 12*b* as the partitioned spaces, may skip the partition wall 14 to thereby be wound in another space, for example, a lower space 12*b* among the two winding spaces 12*a* and 12*b*.

The skip groove 14*a* may be formed such that a portion of the partition wall 14 is entirely removed so that an outer surface of the body part 13 is exposed. In addition, the skip groove 14*a* may have a width wider than a thickness (that is, a diameter) of the coil 50. The skip groove 14*a* may be formed as a pair, corresponding to positions of terminal connection parts 20*a* and 20*b* to be described below.

The partition wall 14 according to the present embodiment may be provided in order to approximately uniformly dispose and wind the coil 50 in the winding spaces 12*a* and 12*b*. Therefore, the partition wall may have various thicknesses and be formed of various materials, as long as a shape thereof may be maintained.

Meanwhile, although the case in which the partition wall 14 is formed integrally with the bobbin 10 is described by way of example in the present embodiment, the present invention is not limited thereto, but may be variably modified. For example, the partition wall 14 may also be formed as an independent separate member and be then coupled to the bobbin 20.

The partition wall 14 according to the present embodiment may have approximately the same shape as that of the flange part 15.

The flange part 15 may be protruded in a shape in which it is extended from both ends, that is, upper and lower ends, of the body part 13 in the outer diameter direction. The flange part 15 according to the present embodiment may be divided into an upper flange part 15*a* and a lower flange part 15*b* according to a formation position thereof.

In addition, an outer peripheral surface of the body part 13, that is, a space between the upper and lower flange parts 15*a* and 15*b* may be formed as the winding spaces 12*a* and 12*b* in which the coil 50 is wound. Therefore, the flange part 15 may serve to protect the coil 50 from the outside and secure insulation properties between the coil 50 and the outside, while simultaneously serving to support the coils 50 in the winding spaces 12*a* and 12*b* at both sides thereof.

The terminal connection part 20 may be formed in the lower flange part 15*b*. More specifically, the terminal connection part 20 according to the present embodiment may be formed to have a shape in which it is protruded from the lower flange part 15*b* in the outer diameter direction in order to secure an insulation distance.

However, the present invention is not limited thereto. That is, the terminal connection part 20 may also be formed to have a shape in which it is protruded downwardly of the lower flange part 15*b*.

Meanwhile, referring to the accompanying drawings, since the terminal connection part 20 according to the present embodiment is formed to have a shape in which it is partially extended from the lower flange part 15*b*, it is difficult to precisely distinguish between the lower flange part 15*b* and the terminal connection part 20. Therefore, in the terminal connection part 20 according to the present embodiment, the lower flange part 15*b* itself may also be perceived as the terminal connection part 20.

External connection terminals 30 to be described below may be connected to the terminal connection part 20 to be protruded outwardly.

In addition, the terminal connection part 20 according to the present embodiment may include a primary terminal connection part 20*a* and a secondary terminal connection part 20*b*. Referring to FIG. 1, the case in which the primary terminal connection part 20*a* and the secondary terminal connection part 20*b* are respectively extended from both ends of the lower flange part 15*b* exposed to the outside of the core 40 is described by way of example in the present embodiment. However, the present invention is not limited thereto but may be variably modified. For example, the primary terminal connection part 20*a* and the secondary terminal connection part 20*b* may also be formed on any one end of the lower flange part 15*b* or be formed in positions adjacent to each other.

In addition, the terminal connection part 20 according to the present embodiment may include a lead groove 25, a catching groove 26, guide protrusions 27, and catching protrusions 28 in order to guide a lead wire L of the coil 50 wound in the winding part 12 to the external connection terminal 30.

The lead groove 25 may be used in the case in which the lead wire L of the coil 50 wound in the winding part 12 is led to a lower portion of the terminal connection part 20. To this end, the lead groove 25 according to the present embodiment may be formed to have a shape in which portions of the terminal connection part 20 and the lower flange part 15*b* are entirely removed so that the outer surface of the body part 13 is exposed.

In addition, the lead groove 25 may have a width wider than thicknesses (that is, diameters) of a primary coil 51 and a secondary coil 25.

Particularly, the lead groove 25 according to the present embodiment may be formed in a position corresponding to that of the skip groove 14*a* of the partition wall 14 described above. More specifically, the lead groove 25 may be formed in a position at which the skip groove 14*a* projects downwardly.

The lead groove 25 may be formed as a pair, corresponding to the position of the terminal connection part 20, similar to the skip groove 14*a*. In this case, two lead grooves 25 may be a first lead groove 25*a* through which the primary coil is led and a second lead groove 25*b* through which the secondary coil lead groove 25*b* is led. However, the present invention is not limited thereto. That is, a number of lead grooves 25 may also be formed at various positions as needed.

The catching groove 26 may be formed in the lead groove 25 and be formed to have a shape in which a width of the lead groove 25 is extended. That is, the catching groove 26 may be formed as an elongated groove having a shape in which it is formed across the lead groove 25 and has a width of a size at which the coil 50 may be led to the outside while penetrating therethrough.

In addition, the catching groove 26 may be formed to have a shape in which it has a width extended from the lead groove 25 in both of two opposite directions or be formed to have a shape in which it has a width extended in any one direction.

A lower portion of the catching groove 26, that is, an edge portion thereof connected to a lower surface of the terminal connection part 20 may be formed as an inclined surface or a curved surface through chamfering, or the like. Therefore, a phenomenon in which the lead wire L led through the catching groove 26 is bent by the edge portion of the catching groove 26 may be significantly reduced.

In addition, the catching groove 26 according to the present embodiment may be formed under the primary coil 51 and the secondary coil 52 continuously wound in the winding part 12 in a shape in which the terminal connection part 20 is cut in a winding direction of each coil 50. That is, although the catching groove 26 is formed by being cut in a linear manner in the present embodiment, the present invention is not limited thereto. That is, the catching groove 26 may also be formed by being cut to have an arc according to a winding shape of the coil 50 wound in a ring shape.

In addition, the catching groove 26 according to the present embodiment may include two catching grooves 26*a* and 26*c* formed in the first lead groove 25*a* through which the primary coil 51 is led and one catching groove 26*b* formed in the second lead groove 25*b* through which the secondary coil 52 is led. A configuration of this catching groove 26 will be described in more detail in a description of the coil 50 below.

Meanwhile, in the transformer 100 according to the present embodiment, leakage inductance generated at the time of driving thereof may be significantly reduced by the lead groove 25 and the catching groove 26 according to the present embodiment.

In the case of the transformer according to the related art, generally, the lead wire of the coil is configured such that it is led to the outside along an inner wall surface of a space in which the coil is wound, such that the wound coil and the lead wire of the coil are in contact with each other.

Therefore, the coil is wound such that it is bent at a portion at which it contacts the lead wire thereof, and this bending, that is, non-uniform winding, of the coil causes an increase in leakage inductance.

However, in the transformer 100 according to the present embodiment, the lead wire L of the coil 50 is not disposed in the winding part 12, but is directly led from a position in which it is wound, to an outer portion of the winding part 12, that is, the lower portion of the terminal connection part 20, through the lead groove 25 and the catching groove 26 in a vertical direction.

Therefore, the coil 50 wound in the winding part 12 may be entirely uniformly wound therearound, such that the leakage inductance generated due to the bending of the coil 50 described above, or the like, may be significantly reduced.

A plurality of catching protrusions 28 may be protruded from one surface of the terminal connection part 20. The case in which the plurality of catching protrusions 28 are protruded downwardly from the outer surface (the lower surface) of the terminal connection part 20 is described by way of example in the present embodiment.

The plurality of catching protrusions 28 are provided to guide the lead wire L of the coil 50 wound in the winding part 12 so that the lead wire L may be easily disposed in a direction from the lower portion of the terminal connection part 20 to the external connection terminal 30, as shown in FIG. 2B. Therefore, the plurality of catching protrusions 28 may be protruded beyond a diameter of the lead wire L of the coil 50 so as to firmly support the coil 50 supported by the plurality of catching protrusions 28 while being caught by the plurality of catching protrusions 28.

Due to the catching protrusions 28, the lead wires L led from the catching groove 26 may be disposed in various directions, as needed.

Particularly, the plurality of catching protrusions 28 according to the present embodiment may be provided in order to easily change a disposition direction of the lead wires L led from the catching groove 26 in the winding direction.

Therefore, in the case in which all of the external connection terminals 30 to which the lead wires L are connected are disposed in a leading direction of the lead wires L, led from the catching groove 26 as in the secondary terminal connection part 20*b*, this catching protrusion 28 may be omitted. However, in the case in which corresponding external connection terminals 30 are disposed in an opposite direction to the leading direction of the lead wires L as in the primary terminal connection part 20*a*, the lead wires L may be disposed at an altered direction while supporting the plurality of catching protrusions 28.

The direction in which the lead wires L are provided, a direction opposite to the leading direction thereof while supporting the plurality of catching protrusions 28, may be additionally reversed, with regard to a disposition direction thereof, to a direction in which the external connection terminals 30 are connected while supporting another catching protrusion 28.

To this end, at least one of the catching protrusions 28 according to the present embodiment may be disposed such that it is adjacent to the catching groove 26.

Meanwhile, at least one of the catching protrusions 28 according to the present embodiment may be configured to have a step formed at least one side thereof.

Figure 5:
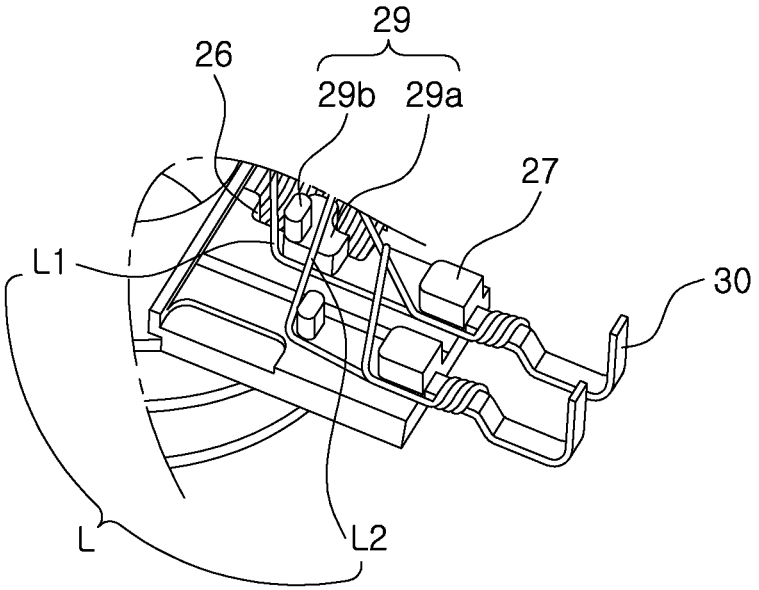
FIG. 5 is a partially enlarged perspective view of a double catching protrusion shown in FIG. 3B.

FIG. 5 is a partially enlarged perspective view of a double catching protrusion shown in FIG. 3B. Referring to FIG. 5, a catching protrusion having the step, (hereinafter, a double catching protrusion 29), may include a base protrusion 29*a* and a support protrusion 29*b*.

The base protrusion 29*a* may be protruded so that a distal end thereof has a predetermined area. Therefore, the base protrusion 29*a* may not only support a lead wire L1 through a sidewall thereof but also support a lead wire L2 through the distal end thereof, similar to the other catching protrusion 28. That is, the base protrusion 29*a* may simultaneously support at least two lead wires L1 and L2.

This base protrusion 29*a* may be protruded to a height higher than a thickness of the lead wire L1. Therefore, the lead wire L1 supported by the sidewall of the base protrusion 29*a* and the lead wire L2 supported by the distal end of base protrusion 29*a* may be disposed to be spaced apart from each other by a predetermined interval.

The support protrusion 29*b* may be further protruded from any one portion in the distal end of the base protrusion 29*a*. The support protrusion 29*b* may have a shape, a size, and the like, similar to those of other catching protrusions 28 except that it is protruded from the distal end of the base protrusion 29*a*.

The support protrusion 29*b* may prevent the lead wire L supported by the distal end of the base protrusion 29*a* from moving in a specific direction. In addition, the support protrusion 29*b* may prevent the lead wire L supported by the sidewall of the base protrusion 29*a* from being easily separated from the double catching protrusion 29.

The double catching protrusion 29 according to the present embodiment configured as described above may be provided in order to prevent the lead wires L from contacting while intersecting each other in a process in which the lead wires L are disposed on the lower surface of the terminal connection part 20.

As shown in FIG. 3B, as the disposal of the lead wires L becomes complicated, the lead wires L may be disposed so as to intersect each other while contacting each other. Therefore, in order to prevent this phenomenon, the transformer 100 according to the present embodiment may include the above-mentioned double catching protrusion 29.

Since the transformer 100 includes the double catching protrusion 29, a specific lead wire L1 led from the catching groove 26 may be disposed in an altered direction while being supported by the sidewall formed by both the base protrusion 29*a* and the support protrusion 29*b*.

In addition, another lead wire L2 disposed so as to intersect with the above-mentioned specific lead wire L1 may be disposed while being supported by the distal end of the base protrusion 29*a*. Therefore, since the specific lead wire L1 and another lead wire L2 intersect each other while being spaced apart from each other by a predetermined interval, interference therebetween may be significantly reduced.

A plurality of guide protrusions 27 may be formed to be protruded from one surface of the terminal connection part 20 in parallel. The case in which the plurality of guide protrusions 27 are protruded downwardly from the lower surface of the terminal connection part 20 is described by way of example in the present embodiment.

The guide protrusions 27 may be formed at a distal end of the terminal connection part 20 so as to be protruded in parallel with each other corresponding to coupling positions of the external connection terminals 30. Here, the respective guide protrusions 27 may have the same shape or have various shapes as needed as in the guide protrusions 27 formed at the secondary terminal connection part 20*b*.

The guide protrusion 27 is to guide the lead wire L of the coil 50 led from the catching groove 26 or the catching protrusion 28 so that the lead wire L may be easily disposed in the external connection terminal 30, as shown in FIG. 2B. Therefore, the guide protrusions 27 may be protruded beyond a diameter of the lead wire L of the coil 50 so as to guide the coil 50 disposed therebetween while firmly supporting the coil 50.

Due to these guide protrusions 27, the lead wires L led to the outside of the terminal connection part 20 through the catching groove 26 may be disposed in the altered direction while supporting the catching protrusion 28 and electrically connected to the external connection terminals 30 through a space between the guide protrusions 27.

The terminal connection part 20 according to the present embodiment configured as described above was derived in consideration of the case in which the coil 50 is automatically wound in the bobbin 10.

That is, due to the configuration of the bobbin 10 according to the present embodiment, a process of winding the coil 50 in the bobbin 10, a process of skipping the lead wire L of the coil 50 to the lower portion of the bobbin 10 via the skip groove 25 and the catching groove 26, a process of changing a route of the lead wire L through the guide protrusion 27 to lead the lead wire L in a direction in which the external connection terminal 30 is formed and then connecting the lead wire L to the external connection terminal 30, and the like, may be automatically performed through a separate automatic winding device (not shown).

The terminal connection part 20 may include a plurality of external connection terminals 30 connected thereto. The external connection terminals 30 may be protruded outwardly from the terminal connection part 20 and be variously shaped, according to a shape or a structure of the transformer 100 or a structure of a substrate on which the transformer 100 is mounted.

That is, the external connection terminals 30 according to the present embodiment may be connected to the terminal connection part 20 so that they are protruded from the terminal connection part 20 in an outer diameter direction of the body part 13. However, the present invention is not limited thereto. The external connection terminals 30 may be formed in various positions as needed. For example, the external connection terminals 30 may be connected to the terminal connection part 20 so that they are protruded downwardly from the lower surface of the terminal connection part 20.

In addition, the external connection terminal 30 according to the present embodiment may include an input terminal 30*a* and an output terminal 30*b*.

The input terminal 30*a* may be connected to the primary terminal connection part 20*a* and be connected to the lead wire L of the primary coil 51 to supply power to the primary coil 51. In addition, the output terminal 30*b* may be connected to the secondary terminal connection part 20*b* and be connected to the lead wire L of the secondary coil 52 to supply output power set according to a turns ratio between the secondary coil 52 and the primary coil 51 to the outside.

The external connection terminal 30 according to the present embodiment may include a plurality of (for example, four) input terminals 30*a* and a plurality of (for example, seven) output terminals 30*b*. This configuration was derived because the transformer 100 according to the present embodiment is configured so that a plurality of coils 50 are wound together in a single winding part 12 while being stacked therein. Therefore, in the transformer 100 according to the present embodiment, the number of external connection terminals 30 is not limited to the above-mentioned number.

In addition, the input terminal 30*a* and the output terminal 30*b* may have the same shape or have different shapes as required. In addition, the external connection terminal 30 according to the present embodiment may be variously modified as long as the lead wire L may be more easily connected thereto.

The bobbin 10 according to the present embodiment as described above may be easily manufactured by an injection molding method, but is not limited thereto. In addition, the bobbin 10 according to the present embodiment may be formed of an insulating resin and be formed of a material having high heat resistance and high voltage resistance. As a material of the bobbin 10, polyphenylenesulfide (PPS), liquid crystal polyester (LCP), polybutyleneterephthalate (PBT), polyethyleneterephthalate (PET), phenolic resin, and the like, may be used.

The core 40 may be partially inserted into the through hole 11 formed in an inner portion of the bobbin 10 and be electromagnetically coupled to the coil 50 to form a magnetic path.

The core 40 according to the present embodiment may be configured as a pair. A pair of cores 40 may be partially inserted into the through hole 11 of the bobbin 10 to thereby be coupled to each other while facing each other. As the core 40, an 'EE' core, an 'EI' core, a 'UU' core, a 'UI' core, or the like, according to a shape thereof, may be used.

In addition, the core 40 according to the present embodiment may have an hourglass shape in which a portion contacting the flange part 15 is partially concave, according to a shape of an insulating rib 19 of the bobbin 10, described above. However, the present invention is not limited thereto.

The core 40 may be formed of Mn—Zn based ferrite having higher permeability, lower loss, higher saturation magnetic flux density, higher stability, and lower production costs, as compared to other materials. However, in the embodiment of the present invention, a shape or a material of the core 40 is not limited.

Meanwhile, although not shown, in order to secure insulation properties between the coil 50 wound in the bobbin 10 and the core 40, insulating tape may be interposed between the bobbin 10 and the core 40.

The insulating tape may be interposed between the bobbin part 10 and the core 40 corresponding to the entire inner surface of the core 40 facing the bobbin 10 or be partially interposed therebetween only at a portion at which the coil 50 and the core 40 face each other The coil 50 may be wound in the winding part 12 of the bobbin 10 and include the primary and secondary coils.

Figure 6A:
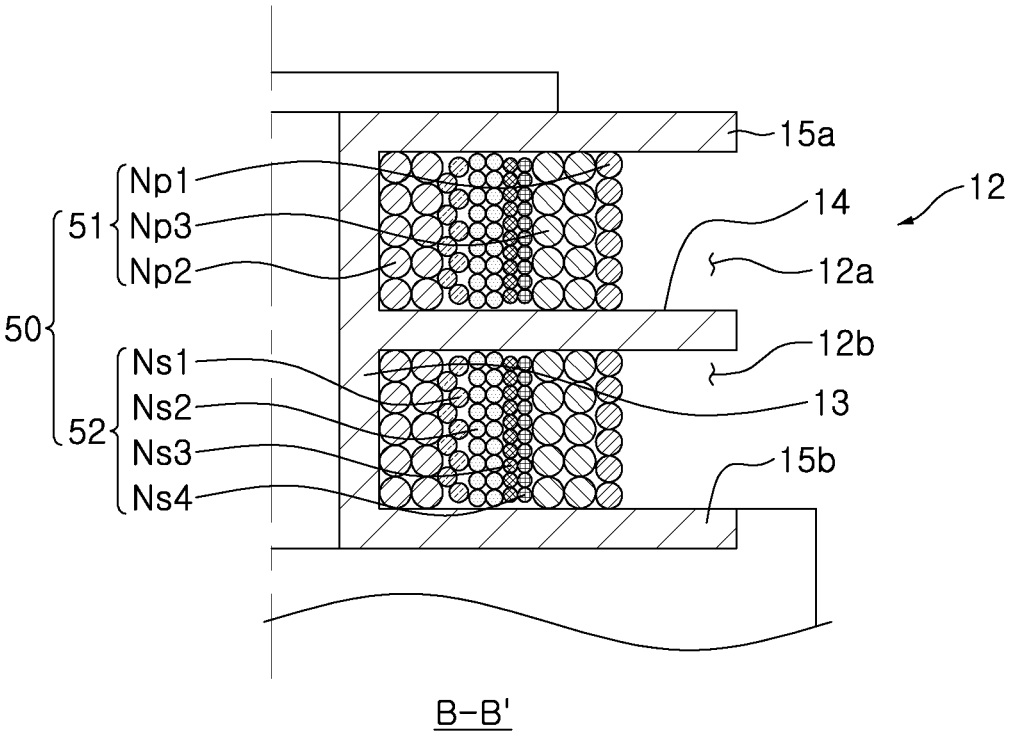
FIG. 6A is a cross-sectional view taken along line B-B' of FIG. 3B.
Figure 6B:
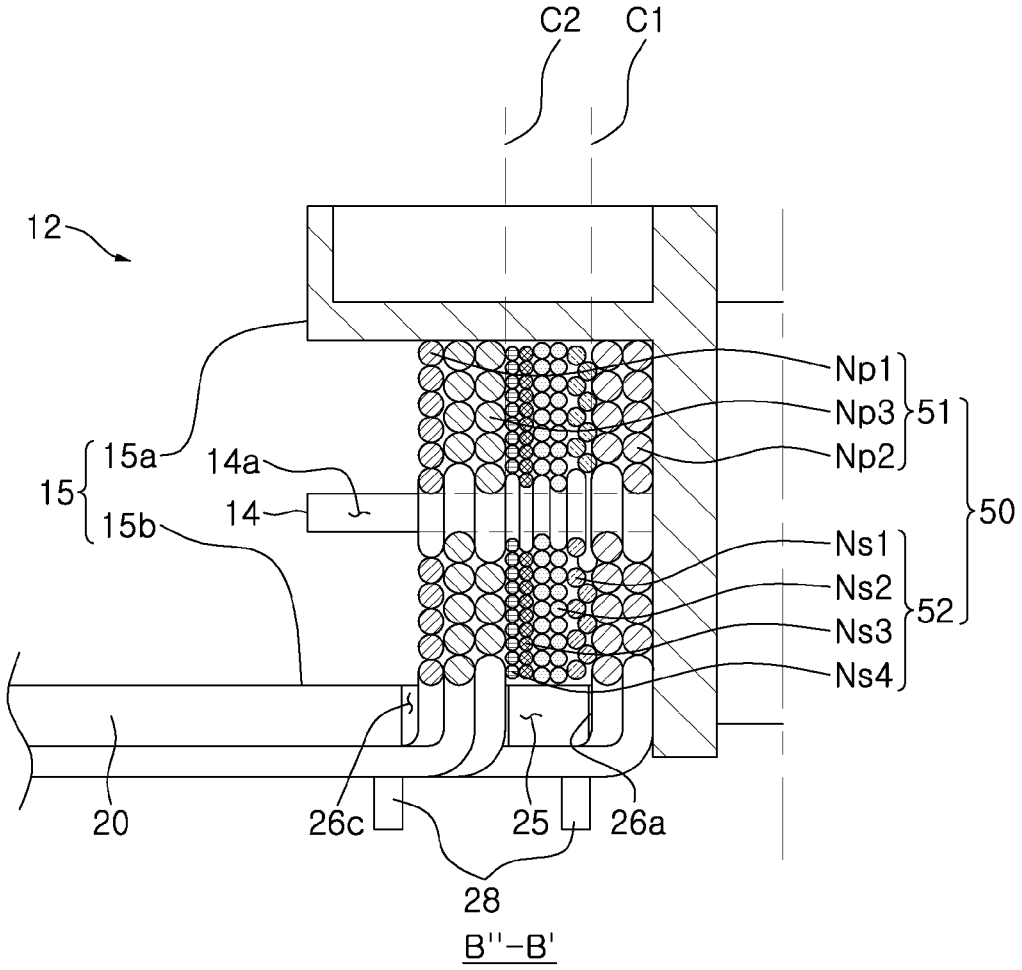
FIG. 6B is a cross-sectional view taken along line B"-B' of FIG. 3B.

FIG. 6A is a cross-sectional view taken along line B-B' of FIG. 3B; FIG. 6B is a cross-sectional view taken along line B"-B' of FIG. 3B; and FIG. 6C is a cross-sectional view taken along line B'-B"' of FIG. 3B.

Figure 6C:
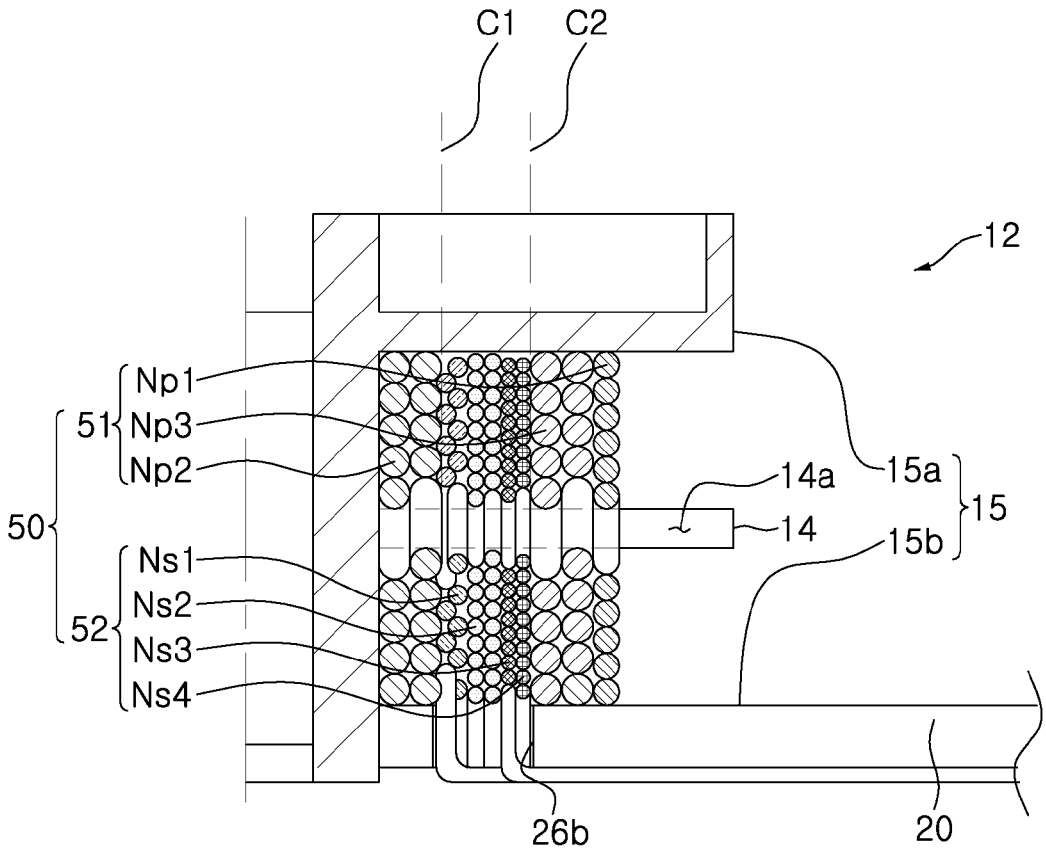
FIG. 6C is a cross-sectional view taken along line B'-B'" of FIG. 3B.

Referring to FIGS. 6A through 6C, the primary coil 51 may include a plurality of coils Np1, Np2, and Np3 that are electrically insulated from each other. The case in which the primary coil 51 is formed by winding each of three independent coils Np1, Np2, and Np3 in a single winding part 12 is described by way of example in the present embodiment. Therefore, in the primary coil 51 according to the present embodiment, a total of six lead wires L may be led out and connected to the external connection terminals 30. Meanwhile, for convenience of description, only a few lead wires L are representatively shown in FIG. 1.

Referring to FIG. 6A, a case in which the primary coil 51 according to the present embodiment includes the coils Np1, Np2, and Np3 that have a similar thickness is shown. However, the present invention is not limited thereto. Each of the coils Np1, Np2, and Np3 configuring the primary coil 51 may also have different thicknesses as needed. In addition, the respective coils Np1, Np2, and Np3 may have the same amount of turns or have differing amounts of turns as needed.

Further, in the transformer 100 according to the present invention, when voltage is applied to at least any one (for example, Np2 or Np3) of the plurality of primary coils Np1, Np2, and Np3, voltage may also be provided to the other primary coil (for example Np1) by electromagnetic induction. Therefore, the transformer may also be used in a display device to be described below.

As described above, in the transformer 100 according to the present embodiment, the primary coil 51 is configured of the plurality of coils Np1, Np2, and Np3, such that various voltages may be applied and provided through the secondary coil 52*b* correspondingly.

Meanwhile, the primary coil 51 according to the present embodiment is not limited to the three independent coils Np1, Np2, and Np3 as in the case according to the present embodiment, but may include various amounts of coils as needed.

The secondary coil 52 is wound in the winding part 12, similar to the primary coil 51. Particularly, the secondary coil 52 according to the present embodiment may be wound between the primary coils 51 while being sandwiched therebetween.

The secondary coil 52 may be formed by winding a plurality of coils electrically insulated from each other, similar to the primary coil 51.

More specifically, the case in which the secondary coil 52 includes four independent coils Ns1, Ns2, Ns3, and Ns4 electrically insulated from each other is described by way of example in the present embodiment. Therefore, in the secondary coil 52 according to the present embodiment, a total of eight lead wires L may be led and connected to the external connection terminals 30.

In addition, the respective coils Ns1, Ns2, Ns3, and Ns4 of the secondary coil 52 may have the same thickness or coils having different thicknesses and also have the same amounts of turns or have a different amount of turns as needed.

The respective individual coils Np1 to Ns4 according to the present embodiment may be wound so that they are disposed within the spaces 12*a* and 12*b* defined by the partition wall 14 in an approximately uniform dispersal scheme.

More specifically, the respective coils Np1 to Ns4 may be wound to have the same amount of turns in each of upper and lower winding spaces 12*a* and 12*b* and may be disposed to form vertically identical layers as shown in FIG. 6A. Therefore, the respective coils Np1 to Ns4 wound in the upper and lower winding spaces 12*a* and 12*b* may be wound to have the same shape.

Here, in the case in which the turn of the respective coils Np1 to Ns4 is set as an odd number, corresponding coils Np1 to Ns4 may be wound so as to have differences in amounts of turns in the ratio in 10% of a total turn thereof.

This configuration is to significantly reduce the generation of the leakage inductance in the transformer 100 according to a wound state of the coil 50.

Generally, when the coils are wound in the winding part of the bobbin, in the case in which the coils are not entirely wound uniformly, but are wound while being inclined toward one side or while being non-uniformly disposed, the leakage inductance in the transformer may be increased. In addition, this defect may be intensified as the space of the winding part is increased.

Therefore, in the transformer 100 according to the present embodiment, the winding part 12 may be partitioned into several spaces 12*a* and 12*b* by the partition wall 14 in order to significantly reduce the leakage inductance generated due to the above-mentioned reason. In addition, the coils 50 may be wound as uniformly as possible in the respective winding spaces 12*a* and 12*b*.

For example, in the case in which Ns1 has a total of 18 turns, Ns1 may be wound nine times in the upper winding space 12*a* and nine times in the lower winding space 12*b* such that it is disposed in a uniform dispersal scheme.

Further, in a case in which the turns are set to be wound in odd numbers (for example, 51 times), Ns1 may be wound 23 times in the upper winding space 12*a* and be wound 28 times in the lower winding space 12*b* so as to have a difference in a turns ratio of 10%, as described above.

Meanwhile, referring to the accompanying drawings, in the case of the present embodiment, Ns1 is not densely wound, but is wound eight times in a first layer and is wound ten times in a second layer. Therefore, since both of two lead wires (not shown) of Ns1 are directed to a lower portion of the winding part 12, they may be easily led to the terminal connection part 20 and connected to the external connection terminal 30.

Although the accompanying drawings show the above-mentioned winding structure only with respect to Ns1 for convenience of description, the present invention is not limited thereto. The above-mentioned winding structure may also be easily applied to other coils.

As described above, in the case of the transformer 100 according to the present embodiment, even in the case that the coil (for example, Ns1) may not be densely wound within the winding part 12, due to turns or a thickness of the coil smaller than widths of the winding spaces 12*a* and 12*b*, the winding part 12 is partitioned into a plurality of spaces 12*a* and 12*b*, such that the coil (for example, Ns1) may be wound so as to be disposed at the same position within the respective winding spaces 12*a* and 12*b* in a distributed scheme without being inclined toward any one side.

In the transformer 100 according to the present embodiment as described above, the respective independent coils Np1 to Ns4 may be disposed in the upper and lower winding spaces 12*a* and 12*b* in a uniformly distributed scheme according to the winding scheme and the structure of the bobbin 10 described above. Therefore, in the entire winding part 12, a phenomenon in which the coils Np1 to Ns4 are wound while being inclined toward any one side or are non-uniformly wound while being spaced apart from each other may be prevented, whereby the leakage inductance generated due to the non-uniform winding of the coils Np1 to Ns4 may be significantly reduced.

Meanwhile, as shown in FIGS. 6A and 6B, the catching groove 26 according to the present embodiment may be formed corresponding to contact surfaces C1 and C2 between the primary coil 51 and the secondary coil 52 continuously wound in the winding part 12 while being stacked therein, that is, positions through which the lead wire L is led.

Here, an outer peripheral surface and an inner peripheral surface of the primary coil 51 and the secondary coil 52 that are continuously wound indicate a ring shape outer peripheral surface and inner peripheral surface formed by winding the coils 50 in the winding part 12.

In addition, the contact surfaces C1 and C2 indicate contact surfaces between the outer peripheral surface or the inner peripheral surface of the primary coil 51 and the outer peripheral surface or the inner peripheral surface of the secondary coil 52.

According to the present embodiment, since Np2, as well as Np3 and Np1 are wound while being separated from each other, the primary coil 51 may have two outer peripheral surfaces and inner peripheral surfaces (an outer peripheral surface and an inner peripheral surface by Np2, and an outer peripheral surface and an inner peripheral surface by Np1 and Np3).

On the other hand, since four individual coils Ns1 to Ns4 are continuously wound while being stacked, the secondary coil 52 may have only one outer peripheral surface (that is, an outer peripheral surface by Ns4) and one inner peripheral surface (that is, an inner peripheral surface by Ns1). Here, both of the outer peripheral surface C2 and the inner peripheral surface C1 of the secondary coil 52 may be formed as the contact surfaces C1 and C2.

As shown in the accompanying drawings, the catching groove 26 according to the present embodiment may include a first catching groove 26*a*, a second catching groove 26*b*, and a third catching groove 26*c*, corresponding to each of the coils 50. Here, the first catching groove 26*a* and the third catching groove 26*c* may be extended from the first lead groove 25*a*, and the second catching groove 26*b* may be extended from the second lead groove 25*b*.

In addition, the first catching groove 26*a* may be formed in a position (that is, a lower portion) corresponding to Np2, the second catching groove 26*b* may be formed in a position corresponding to all of the secondary coils 52, and the third catching groove 26*c* may be formed in a position corresponding to Np3 and Np1.

Figure 7:
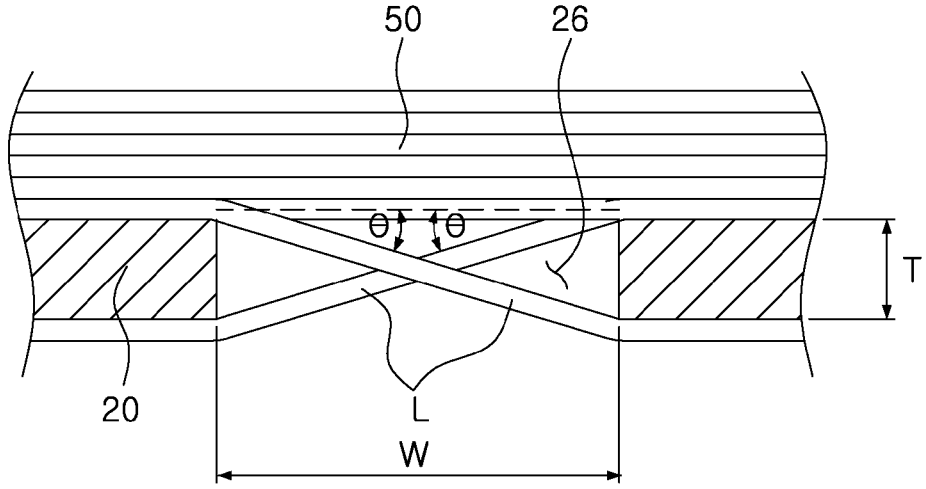
FIG. 7 is a cross-sectional view taken along line C-C' of FIG. 3B.

FIG. 7 is a cross-sectional view taken along line C-C' of FIG. 3B. Referring to FIG. 7, the catching groove 26 according to the present embodiment may have a length W, larger than a thickness T of the terminal connection part. Therefore, an angle θ formed by the length W of the catching groove 26 and the thickness T of the terminal connection part may be less than 45 degrees.

Therefore, the lead wire L of the coil 50 led to the outside of the terminal connection part 20 along the catching groove 26 within the winding part 12 may be led while lengthily intersecting with the catching groove 26 in a length direction of the catching groove 26, such that it is led while forming an angle of less than 45 degrees with respect to another coil 50 wound in the winding part 12.

This configuration of the catching groove 26 according to the present embodiment is to satisfy safety standards (that is, those of Underwriters Laboratories (UL)) with regard to the primary coil 51 and the secondary coil 52 with respect to the lead wires L led from the winding part 12.

According to the UL safety standards, in the case in which the primary coil 51 and the secondary coil 52 contact each other while under tension, an angle (an acute angle) formed in a portion at which the primary coil 51 and the secondary coil 52 intersect each other needs to be set to be less than 45 degrees.

Therefore, when the angle formed by the lead wires L of the primary coil 51 and the secondary coil 52 is 45 degrees or more, UL safety standards are not satisfied.

As described above, in the transformer 100 according to the present embodiment, the lead wire L may be led to the outer surface of the terminal connection part 20 and be then coupled to the external connection terminal 30.

Here, in the case in which the lead wires of the specific coil (for example, the lead wire of Ns4 that is the secondary coil) is led directly downwardly from the above-mentioned contact surfaces C1 and C2, the lead wires may form an angle of 90 degrees in a state in which they contact another order coil (for example, Np3 or Np2 that is the primary coils) that is continuously wound. In this case, the above-mentioned UL safety standards are not satisfied.

Therefore, in order to solve this defect, in the transformer 100 according to the present embodiment, the lead wires L may be led in a manner in which they cross the catching groove 26 in the length direction thereof as described above. That is, the lead wires is not led directly downwardly from the winding part 12, but may be obliquely led so as to have a predetermined inclination in the winding direction. As described above, since the length W of the catching groove 26 is larger than the thickness T of the terminal connection part 30, the lead wire L may form an angle of less than 45 degrees with regard to the coils 50 wound in the winding part 12 while being led. Therefore, the above-mentioned UL standards may be satisfied.

Through the above-mentioned configuration, at least two lead wires led through one catching groove 26 may be disposed so as to intersect each other in an X shape in one catching groove 26, as shown in FIG. 7.

In addition, as the coils Np1 to Ns4 according to the present embodiment, a general insulated coil (for example, a polyurethane wire), or the like, and a twisted pair wire type coil formed by twisting several strands of wires (for example, a Litz wire, or the like) may be used. In addition, a multi-insulated coil (for example, a triple insulated wire (TIW)) having high insulation properties may be used. That is, a kind of the coil may be selected as needed.

Particularly, in the transformer 100 according to the present embodiment, since all (or some) of the respective individual coils are formed of the multi-insulated wire such as the TIW, or the like, insulation properties between the individual coils may be secured. Therefore, insulating tape that has been used in order to insulate the coils of the transformer according to the related art may be omitted.

The multi-insulated wire is a coil of which insulation properties is increased by forming an insulator having several layers (for example, three layers) on an outer portion of a conductor. When the triple insulated coil 51*b* is used, insulation properties between a conductor and the outside are easily secured, whereby an insulation distance between the coils may be significantly reduced. However, this multi-insulated wire may have increased manufacturing costs, as compared to a general insulated coil (for example, a polyurethane-insulated wire).

Therefore, in the transformer according to the present embodiment, in order to significantly reduce manufacturing costs and reduce a required manufacturing process, only any one of the primary and secondary coils 51 and 52 may be the multi-insulated coil.

Again referring to FIG. 5, in the transformer 100 according to the present embodiment, the case in which the primary coils 51 are multi-insulated coils is described byway of example. In this case, the multi-insulated coils, which are the primary coils 51, may be disposed at each of the innermost and outmost portions of the coils 50 wound in the winding part 12 while being stacked therein.

When the multi-insulated coils are disposed at each of the innermost and outmost portions of the coils 50 wound as described above, the multi-insulated coils, which are the primary coils, may serve as an insulating layer between the secondary coils 52, which are general insulated coils, and the outside. Therefore, the insulation properties between the outside and the secondary coil 52 may be easily secured.

Meanwhile, although the case in which the multi-insulated coils, which are the primary coils 51, are disposed at both of the innermost and outmost portions of the coils 50 is described by way of example in the present embodiment, the present invention is not limited thereto. That is, the multi-insulated coils may also be selectively disposed only at any one of the innermost and outmost portions of the coils 50 as needed.

Figure 8:
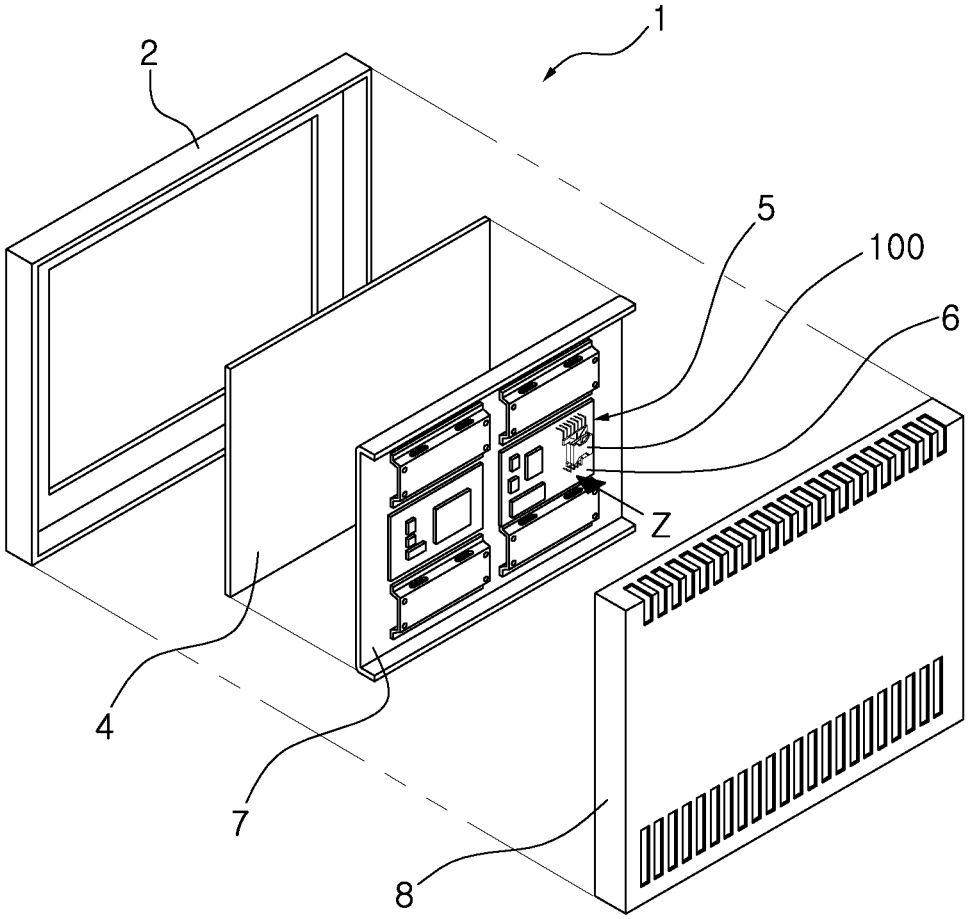
FIG. 8 is an exploded perspective view schematically showing a flat panel display device according to the embodiment of the present invention.

FIG. 8 is an exploded perspective view schematically showing a flat panel display device according to the embodiment of the present invention.

Referring to FIG. 8, the flat panel display device 1 according to the embodiment of the present invention may include a display panel 4, a switching mode power supply (SMPS) 5 having the transformer 100 mounted therein, and covers 2 and 8.

The covers 2 and 8 may include a front cover 2 and a back cover 8 and may be coupled to each other to thereby form a space therebetween.

The display panel 4 may be disposed in an internal space formed by the covers 2 and 8. As the display panel 4, various flat panel display panels such as a liquid crystal display (LCD), a plasma display panel (PDP), an organic light emitting diode (OLED), and the like, may be used.

The SMPS 5 may provide power to the display panel 4. The SMPS 5 may be formed by mounting a plurality of electronic components on a printed circuit board 6 and particularly, may be formed with the transformer 100 mounted therein according to the above-mentioned embodiments.

The SMPS 5 may be fixed to a chassis 7 and be fixedly disposed in the internal space formed by the covers 2 and 8 together with the display panel 4.

Here, in the transformer 100 mounted in the SMPS 5, the coil 50 (See FIG. 1) is wound parallel to the printed circuit board 6. In addition, when viewed from a plane of the printed circuit board 6 (in a Z direction), the coil 50 may be wound clockwise or counterclockwise. Therefore, a portion (an upper surface) of the core 40 may form a magnetic path while being parallel to the back cover 8.

Therefore, in the transformer 100 according to the present embodiment, a path of most of magnetic flux formed between the back cover 8 and the transformer 100 in a magnetic field generated by the coil 50 is formed in the core 40, whereby the generation of leakage magnetic flux between the back cover 8 and the transformer 100 may be significantly reduced.

Therefore, even in the case that the transformer 100 according to the present embodiment does not include a separate shielding device (for example, a shield, or the like) provided on an outer portion thereof, vibrations of the back cover 8 due to interference between the leakage flux of the transformer 100 and the back cover 8 formed of a metal material may be prevented.

Therefore, even in the case that the transformer 100 is mounted in a relatively thin electronic device such as the flat panel display device 1, such that the back cover 8 and the transformer 100 have a relatively significantly narrow space therebetween; the generation of noise due to vibrations of the back cover 8 may be prevented.

As set forth above, in the transformer according to the embodiments of the present invention, the winding space of the bobbin is uniformly partitioned into a plurality of spaces, and the respective individual coils are wound in the winding spaces in a uniform dispersal scheme. In addition, the respective individual coils are wound in a shape in which they are stacked.

Therefore, a phenomenon in which the individual coils are wound within the winding part while being inclined toward anyone side or are non-uniformly wound within the winding part while being spaced apart from each other may be prevented. As a result, leakage inductance generated due to non-uniform winding of the coils may be significantly reduced.

In addition, in the transformer according to the embodiments of the present invention, at least one of the primary and secondary coils may have multi-insulated wire. In this case, due to the multi-insulated wire having high insulation properties, insulation properties between the primary and secondary coils may be secured without using a separate insulating layer (for example, the insulating tape).

Therefore, since the insulating tape interposed between the primary and secondary coils according to the related art and a process of attaching the insulating tape may be omitted, manufacturing costs and a manufacturing time may be reduced.

In addition, the transformer according to the embodiment of the present invention may be configured to be appropriate for an automated manufacturing method. More specifically, in the transformer according to the embodiments of the present invention, the insulating tape according to the related art that has been manually interposed while being wound between the coils may be omitted.

In the case according to the related art in which insulating tape is used, a method of winding the coil in the bobbin, manually attaching the insulating tape thereto, and then again winding the coil is repeatedly performed, leading to an increase in manufacturing time and costs.

However, in the transformer according to the embodiments of the present invention, a process of attaching the insulating tape is omitted, whereby the individual coils may be continuously wound in the bobbin while being stacked therein by an automatic winding device. Therefore, a cost and a time required for manufacturing the transformer may be significantly reduced.

In addition, in the transformer according to the embodiments of the present invention, the lead wires of the coils are not disposed within the winding part, but are directly led to the outside of the winding part through the catching groove. Therefore, the coils wound in the winding part are uniformly wound, whereby leakage inductance due to the bending of the coil, or the like, may be significantly reduced.

Further, in the transformer according to the present embodiment, the length of the catching groove is larger than the thickness of the terminal connection part, and the lead wire of the coil is led in a shape in which it crosses the catching groove in the length direction thereof. Therefore, since the lead wire is led while forming an angle less than 45 degrees with respect to the coils wound in the winding part, UL safety standards may be satisfied. Further, a plurality of catching protrusions and double catching protrusions are provided, whereby the disposition direction of the lead wire may be easily changed.

In addition, when the transformer according to the embodiment of the present invention is mounted on the substrate, the coil of the transformer is maintained in a state in which it is wound parallel to the substrate. When the coil is wound parallel to the substrate as described above, interference between leakage magnetic flux generated from the transformer and the outside may be significantly reduced.

Therefore, even in the case that the transformer is mounted in the thin display device, the generation of the interference between leakage magnetic flux generated from the transformer and the back cover of the display device is significantly reduced, whereby a phenomenon in which noise is generated in the display device by the transformer may be prevented. Therefore, the transformer may also be easily used in the thin display device.

The transformer according to the present invention as described above is not limited to the above-mentioned embodiments, but may be variably modified. For example, the case in which the flange part of the bobbin and the partition wall have quadrangular shapes has been described by way of example in the above-mentioned embodiments. However, the present invention is not limited thereto. That is, the flange part of the bobbin and the partition wall may also be circular, an ellipsoidal, or the like, as needed.

In addition, although the case in which the body part of the bobbin has a circular cross section has been described by way of example in the above-mentioned embodiments, the present invention is not limited thereto, but may be variably modified. For example, the body part of the bobbin may also have an ellipsoidal cross section or a polygonal cross section.

Further, although the case in which the terminal connection part is formed on the lower flange part has been described by way of example in the above-mentioned embodiments, the present invention is not limited thereto, but may be variably modified. For example, the terminal connection part may be formed on the upper flange part.

In addition, although the case in which both of the lead groove and the catching groove are formed in the terminal connection part has been described by way of example in the above-mentioned embodiments, the present invention is not limited thereto, but may be variably modified. For example, the catching groove may be only formed, or the lead groove and the catching groove may be independently formed.

Moreover, although the insulating type switching transformer has been described by way of example in the above-mentioned embodiments, the present invention is not limited, but may be widely applied to any transformer, coil component, and electronic device including a plurality of coils wound therein.

While the present invention has been shown and described in connection with the embodiments, it will be apparent to those skilled in the art that modifications and variations can be made without departing from the spirit and scope of the invention as defined by the appended claims

What is claimed is:

1. A transformer comprising:

a winding part having a plurality of coils including at least one primary coil and at least one secondary coil wound in contact with each other on an outer peripheral surface of a pipe shaped body part while being stacked thereon; and a terminal connection part extended from one end of the winding part in an outer diameter direction thereof and having a plurality of external connection terminals coupled to a distal end thereof, the terminal connection part including at least one catching groove formed such that the coils are led to the outside of the winding part therethrough, and a lead wire of at least one of the coils being led to the outside of the winding part while maintaining a winding direction of the coils, wherein at least one of the lead wires of the at least one primary coil and at least one of the lead wires of at least one secondary coil are disposed to intersect with each other.

2. The transformer of claim 1, wherein a length of the catching groove is larger than a thickness of the terminal connection part in which the catching groove is formed.

3. The transformer of claim 1, wherein when the length of the catching groove is regarded as W and the thickness of the terminal connection part in which the catching groove is formed is regarded as T, W/T>1.

4. The transformer of claim 1, wherein the lead wire led through the catching groove is led while forming an angle less than 45 degrees with respect to the coils wound in the winding part.

5. The transformer of claim 1, wherein at least two of the lead wires led through the catching groove are disposed to intersect each other in an X shape.

6. The transformer of claim 1, wherein the terminal connection part further includes at least one lead groove formed in a radial direction, and the catching groove is formed in the lead groove in a manner in which a width of the lead groove is extended.

7. The transformer of claim 1, wherein the winding part includes a plurality of winding spaces formed by at least one partition wall on the outer peripheral surface of the body part, and the coils are wound such that they are disposed in the plurality of spaces divided by the partition wall in a dispersed scheme.

8. The transformer of claim 7, wherein the partition wall includes at least one skip groove, and the coils are wound while skipping the partition wall via the skip groove.

9. The transformer of claim 1, wherein the catching groove is formed in a position corresponding to the at least one primary coil or the at least one secondary coil that is continuously wound in the winding part while being stacked therein.

10. The transformer of claim 9, wherein the coils are continuously wound so that a plurality of secondary coils are interposed between a plurality of primary coils while being stacked therebetween.

11. The transformer of claim 10, wherein at least one of the primary coils and the secondary coils is a multi-insulated coil.

12. The transformer of claim 1, wherein the terminal connection part includes at least one catching protrusion protruded from an outer surface thereof, and the lead wire led through the catching groove is disposed in an altered direction while supporting the catching protrusion.

13. The transformer of claim 12, wherein the catching protrusion is formed in a position adjacent to the catching groove.

14. A transformer comprising:

a winding part having a plurality of coils wound on an outer peripheral surface of a pipe shaped body part while being stacked thereon; and a terminal connection part extended from one end of the winding part in an outer diameter direction thereof and having a plurality of external connection terminals coupled to a distal end thereof, the terminal connection part including at least one catching groove formed such that the coils are led to the outside of the winding part therethrough, and a lead wire of at least one of the coils being led to the outside of the winding part while maintaining a winding direction of the coils, wherein:

the terminal connection part includes at least one catching protrusion protruded from an outer surface thereof, the lead wire led through the catching groove is disposed in an altered direction while supporting the catching protrusion, and at least one of the catching grooves is a double catching protrusion having a step formed at a side thereof.

15. The transformer of claim 14, wherein the double catching protrusion includes:

a base protrusion protruded so that a distal end thereof has a predetermined area, and simultaneously supporting at least two of the lead wires using the distal end thereof and a sidewall thereof; and a support protrusion further protruded from any one portion in the distal end of the base protrusion.

16. The transformer of claim 1, wherein the catching groove is formed as an elongated cut in a winding direction of the coils or formed to have an arc, and the leads wires of the coils are led to the outside while crossing the catching groove in a length direction of the catching groove.

17. A transformer comprising:

a winding part having a plurality of coils including at least one primary coil and at least one secondary coil wound in contact with each other on an outer peripheral surface of a pipe shaped body part while being stacked thereon; and a terminal connection part extended from one end of the winding part in an outer diameter direction thereof and having a plurality of external connection terminals coupled to a distal end thereof, a lead wire of at least one of the plurality of coils being led to the outside of the terminal connection part while forming an angle less than 45 degrees with respect to the coils wound in the winding part, wherein at least one of the lead wires of the at least one primary coil and at least one of the lead wires of at least one secondary coil are disposed to intersect with each other.

* * * * *